US011043759B2

(12) United States Patent
Ober-Woerder

(10) Patent No.: US 11,043,759 B2
(45) Date of Patent: Jun. 22, 2021

(54) SPRING TERMINAL

(71) Applicant: WAGO Verwaltungsgesellschaft mbH, Minden (DE)

(72) Inventor: Philipp Ober-Woerder, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 16/703,302

(22) Filed: Dec. 4, 2019

(65) Prior Publication Data

US 2020/0176897 A1 Jun. 4, 2020

(30) Foreign Application Priority Data

Dec. 4, 2018 (DE) ..... 20 2018 106 896.2

(51) Int. Cl.

| | |
|---|---|
| ***H01R 4/48*** | (2006.01) |
| ***H01R 13/187*** | (2006.01) |
| ***H01R 13/424*** | (2006.01) |
| ***H01R 13/52*** | (2006.01) |

(52) U.S. Cl.

CPC ..... *H01R 4/4845* (2013.01); *H01R 4/4827* (2013.01); *H01R 4/4836* (2013.01); *H01R 13/187* (2013.01); *H01R 13/424* (2013.01); *H01R 13/5213* (2013.01)

(58) Field of Classification Search

CPC ..... H01R 4/4845

See application file for complete search history.

(56) References Cited

U.S. PATENT DOCUMENTS

| | | | | |
|---|---|---|---|---|
| 9,466,895 | B2 | 10/2016 | Köllmann et al. | |
| 9,543,700 | B2 * | 1/2017 | Kollmann | H01R 13/62905 |
| 10,033,119 | B2 | 7/2018 | Koellmann | |

FOREIGN PATENT DOCUMENTS

| | | | |
|---|---|---|---|
| DE | 10 2013 101 406 | A1 | 8/2014 |
| DE | 10 2013 101 409 | A1 | 8/2014 |
| DE | 10 2014 119 421 | A1 | 6/2016 |
| DE | 10 2015 104 625 | A1 | 9/2016 |
| DE | 10 2016 108 826 | A1 | 11/2017 |
| DE | 10 2016 116 966 | A1 | 3/2018 |
| JP | 4289230 | B2 | 4/2009 |

* cited by examiner

*Primary Examiner* — Ross N Gushi

(74) *Attorney, Agent, or Firm* — Muncy, Geissler, Olds & Lowe, P.C.

(57) ABSTRACT

A spring terminal for connection of an electrical conductor including a bus bar, a clamping spring; a housing; and a lever. The bus bar and the clamping spring and the lever are accommodated at least partially in the housing. The lever has a first support disk with a first partially circular outer contour for supporting the lever in a first bearing shell. The lever has a second support disk with a second partially circular outer contour for supporting the lever in a second bearing shell. The second support disk is spaced apart from the first support disk. The lever has an operating handle that is connected to the first support disk and to the second support disk. The clamping spring has a clamping leg that forms a clamping point with the bus bar for clamping the electrical conductor to the bus bar.

21 Claims, 8 Drawing Sheets

SPRING TERMINAL

This nonprovisional application claims priority under 35 U.S.C. § 119(a) to German Patent Application No. Germany 20 2018 106 896.2, which was filed in Germany on Dec. 4, 2018, and which is herein incorporated by reference.

BACKGROUND OF THE INVENTION

Field of the Invention

The present invention relates to a spring terminal for electrical conductors.

Description of the Background Art

A conductor terminal with a housing, a pivoted lever, a bus bar accessible through an entry opening of the housing, and a clamping spring is known, for example, from DE 10 2015 104 625 A1. The pivoted lever of the conductor terminal has an axial strut pivotably supported in the housing, about which the pivoted lever can be pivoted between its open position and closed position. Formed between an operating handle and a pusher element of the pivoted lever is a receiving opening of the pivoted lever through which a holding leg and a clamping leg of the clamping spring are passed.

DE 10 2016 116 966 A1 relates to a spring-loaded terminal with at least one clamping spring for clamping an electrical conductor to the spring-loaded terminal. The spring-loaded terminal has an operating element for opening a clamping point for the electrical conductor that is formed at least in part by means of a clamping edge of the clamping spring. The operating element has a spring engagement region that is equipped to deflect an operating section of the clamping spring at least during opening of the clamping point. In opposition to the force of the clamping spring acting on the spring engagement region, the operating element is supported on a support section of the clamping spring.

SUMMARY OF THE INVENTION

It is therefore an object of the present invention to provide a spring that is improved to the greatest degree possible.

In an exemplary embodiment, a spring terminal for connection of an electrical conductor is provided. The spring terminal has a bus bar and a clamping spring and a housing and a lever. The bus bar is designed for electrically contacting the electrical conductor.

The bus bar and the clamping spring and the lever are accommodated at least partially in the housing. Preferably, the housing is electrically insulating, for example is made of plastic, and has the effect that electrically conductive elements, such as bus bars or clamping springs for example, cannot be touched directly by a user's hand.

The lever has a first support disk with a first partially circular outer contour for supporting the lever in a first bearing shell. The lever has a second support disk with a second partially circular outer contour for supporting the lever in a second bearing shell.

The second support disk is spaced apart from the first support disk. Preferably, the second support disk is spaced apart from the first support disk at least in the axial direction.

The lever has an operating handle that is connected to the first support disk and to the second support disk.

The clamping spring has a clamping leg. The clamping leg forms a clamping point with the bus bar for clamping the electrical conductor to the bus bar.

The lever has a driver that is designed to move the clamping leg from a closed position to an open position when the lever is pivoted.

The first bearing shell can be formed from a first housing section of the housing with a partially circular inner contour and from a first bus bar wall section of the bus bar with an inner contour.

The second bearing shell can be formed from a second housing section of the housing with a partially circular inner contour and from a second bus bar wall section of the bus bar with an inner contour.

The first bus bar wall section of the bus bar can have a partially circular inner contour.

The second bus bar wall section of the bus bar can have a partially circular inner contour.

A radius of the first partially circular outer contour of the first support disk may be no larger than a radius of the partially circular inner contour of the first housing section and/or of the first bus bar wall section.

A radius of the second partially circular outer contour of the second support disk may be no larger than a radius of the partially circular inner contour of the second housing section and/or of the second bus bar wall section.

The first partially circular outer contour of the first support disk and the partially circular inner contour of the first housing section and the partially circular inner contour of the first bus bar wall section can have the same radius.

The second partially circular outer contour of the second support disk and the partially circular inner contour of the second housing section and the partially circular inner contour of the second bus bar wall section can have the same radius.

The housing can have a receptacle part with an interior for accommodating at least the bus bar and a cover. In advantageous fashion, the cover closes an opening of the receptacle part leading into the interior.

The cover can have the first housing section for forming the first bearing shell. The cover can have the second housing section for forming the second bearing shell.

The housing can have a first guide wall and/or a second guide wall of a conductor guide passage. The conductor guide passage guides the electrical conductor to the clamping point. For example, the electrical conductor is inserted into a conductor opening from outside. The first and/or second guide wall is formed by the cover of the housing, for example. Advantageously, the conductor guide passage can be circumferentially closed at least in sections. Advantageously, the conductor guide passage can be formed in the cover at least in sections.

A conductor guide passage for accommodating the electrical conductor can be formed in the region of the first support disk and the second support disk by a space between the first support disk and the second support disk. In advantageous fashion, the space can be additionally bounded by the bus bar at least on a third side.

The first housing section and a first inner side of the first support disk facing the electrical conductor can be aligned at least in the conductor insertion direction. According to an advantageous improvement, the second housing section and a second inner side of the second support disk facing the electrical conductor can be aligned at least in the conductor insertion direction. An alignment includes a minor offset within the scope of manufacturing tolerances. The goal is that strands of a stranded wire do not strike edges formed by an offset and bend such that these strands no longer reach the clamping point in consequence.

The conductor guide passage can be closed laterally by the first inner side of the first support disk and the first housing section and the first bus bar wall section except for gaps between first support disk and first housing section and between first support disk and first bus bar wall section and between first bus bar wall section and housing section. For example, the conductor guide passage can be closed laterally at least over a height of the electrical conductor. The gaps advantageously are limited to a minimum dimension required for manufacturing or assembly. The gaps shown in the figures are solely by way of example and do not limit the scope of protection. According an advantageous improvement, the gaps between first support disk and first housing section and between first support disk and first bus bar wall section and between first bar wall section and first housing section are closed toward the outside by walls of the housing. Advantageously, the walls of the housing can be directly adjacent to the gaps.

The conductor guide passage can be closed laterally by the second inner side of the second support disk and the second housing section and the second bus bar wall section except for gaps between second support disk and second housing section and between second support disk and second bus bar wall section and between second bus bar wall section and second housing section. Preferably, the conductor guide passage is closed laterally at least over a height of the electrical conductor. The gaps advantageously are limited to a minimum dimension required for manufacturing or assembly. The gaps shown in the figures are solely by way of example and do not limit the scope of protection. The gaps between second support disk and second housing section and between second support disk and second bus bar wall section and between second bus bar wall section and second housing section can be closed toward the outside by walls of the housing. The walls of the housing can be directly adjacent to the gaps.

The bus bar can form a contact frame together with a bottom section and a fastening section and the first bus bar wall section and/or the second bus bar wall section. The contact frame can be designed to accommodate the clamping spring so that a self-supporting system is formed.

The bottom section and the fastening section and the first bus bar wall section and the second bus bar wall section of the bus bar can be formed in one piece of a metal part.

The clamping spring can have the clamping leg and a support leg, and has a spring bend connecting the clamping leg and support leg. The spring bend can also be referred to as a spring base. According to an advantageous improvement, the clamping spring has exactly one spring bend.

The support leg of the clamping spring and the fastening section of the bus bar can have a bearing for mounting the support leg and the fastening section on one another. For example, the fastening section has an opening in which a formation of the clamping spring is positioned to form the bearing, or conversely with an opening in the clamping spring and a formation on the fastening section.

The first bus bar wall section and/or the second bus bar wall section can have a surface that adjoins the, for example circular, inner contour and forms a stop for the lever in the open position.

The first housing section of the housing and/or the second housing section of the housing can have a housing surface that adjoins the partially circular inner contour and forms a stop for the lever in the closed position.

The housing can have a cover with a first housing section for forming the first bearing shell and with a second housing section for forming the second bearing shell. For example, a first partially circular inner contour of the first housing section extends, viewed in the conductor insertion direction, —starting from the direction of the conductor guide passage—to behind a pivot axis of the first support disk. Also, for example, a second partially circular inner contour of the second housing section extends, viewed in the conductor insertion direction, —starting from the direction of the conductor guide passage—to behind a pivot axis of the second support disk.

The first support disk in the open position rests on the partially circular contour of the first housing section and on the, for example, partially circular, inner contour of the first bus bar wall section. The first support disk in the closed position rests on the partially circular inner contour of the first housing section and on the, for example partially circular, inner contour of the first bus bar wall section.

The second support disk in the open position rests on the partially circular inner contour of the second housing section and on the, for example, partially circular, inner contour of the second bus bar wall section. The second support disk in the closed position rests on the partially circular inner contour of the second housing section and on the, for example, partially circular, inner contour of the second bus bar wall section.

Preferably, the first support disk does not lose contact with the partially circular inner contours of the first housing section and of the first bus bar wall section during pivoting. Preferably, the second support disk does not lose contact with the partially circular inner contours of the second housing section and of the second bus bar wall section during pivoting. Advantageously, the probability that a strand of a multi-strand conductor will catch in the remaining gaps is significantly reduced.

The bus bar can have a tab for forming a conductor-retaining pocket for the electrical conductor, wherein the tab limits an insertion depth of the electrical conductor.

The fastening section of the bus bar can have an extension as a support for supporting a support leg of the clamping spring.

The first partially circular outer contour of the first support disk and the second partially circular outer contour of the second support disk can define a pivot axis of the lever during pivoting of the lever from the closed position into the open position. Accordingly, the lever can be moved from the open position into the closed position by another actuation.

According to an advantageous improvement, no part of the lever projects the radial direction beyond the first partially circular outer contour in the region of the partially circular outer contour. According to an advantageous improvement, no part of the lever projects outward beyond the first partially circular outer contour in the axial direction in the region of the first partially circular outer contour. According to an advantageous improvement, no part of the lever projects in the radial direction beyond the second partially circular outer contour in the region of the second partially circular outer contour. According to an advantageous improvement, no part of the lever projects outward beyond the second partially circular outer contour in the axial direction in the region of the second partially circular outer contour. The installation space can be reduced significantly through a compact design of the first and second support disks.

The driver can be located at least partially within a first circular area of the first support disk defined by the first outer contour and/or at least partially within a second circular area of the second support disk defined by the second outer contour.

The driver can have a domed outer surface, so that the distance between a region of the surface of the driver that is in contact with the clamping leg and the pivot axis changes during pivoting of the lever. Preferably, the distance in the open position is greater than in the closed position.

The driver can have a predominantly oval or predominantly kidney-shaped or predominantly elliptical cross-sectional shape.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way illustration only, and thus, are not limitive of the present invention, and wherein.

DETAILED DESCRIPTION

Figure 1:
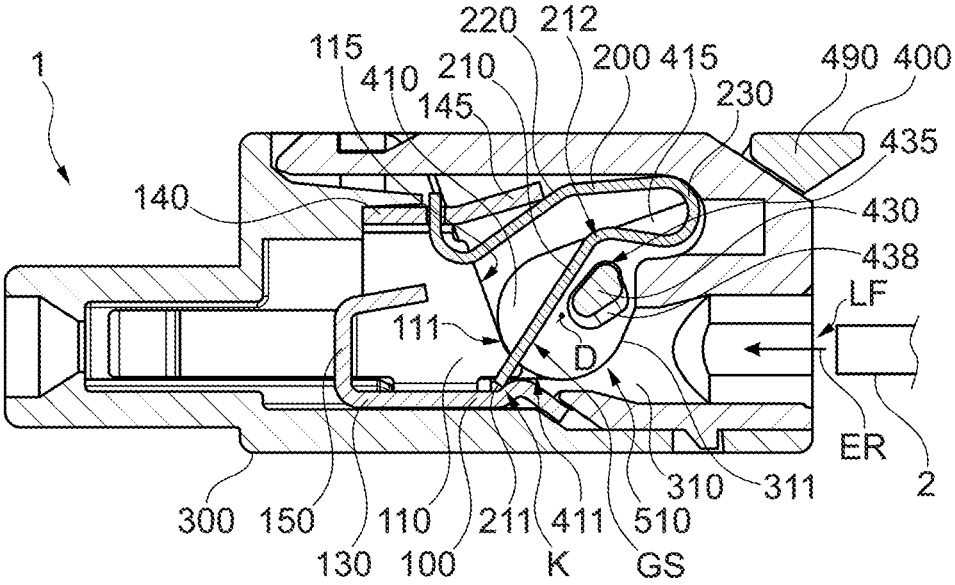
FIG. 1 is a sectional view of an exemplary embodiment.

In FIG. 1, an exemplary embodiment of a spring terminal 1 for of an electrical conductor 2 is shown. The conductor 2 is only shown partially and schematically in FIG. 1. For example, the conductor 2 is a cable with insulation and is single-strand, multi-strand, or fine-strand design.

In the exemplary embodiment from FIG. 1, the conductor terminal 1 has a bus bar 100, a clamping spring 200, a housing 300, and a lever 400. The conductor terminal 1 has the function of connecting the conductor 2 and creating a mechanical and electrical connection. An electrical connection is produced between the conductor 2, for example a copper or aluminum conductor, and the bus bar 100. The bus bar 100 is likewise made of metal, and has properties optimized for electrical conductivity and an electrical contact with the conductor 2.

In the exemplary embodiment from FIG. 1, the bus bar 100 and the clamping spring 200 and the lever 400 are accommodated at least partially in the housing 300. In the exemplary embodiment from FIG. 1, the lever 400 projects partially out of the housing 300. In contrast, the clamping spring 200 and the bus bar 100 are enclosed by the electrically insulating housing 300.

In the exemplary embodiment from FIG. 1, the lever 400 is shown in cross-section. The lever 400 has a first support disk 410 with a first partially circular outer contour 411 for supporting the lever 400 in a first bearing shell 510. In contrast, in FIG. 1 a second support disk 420 of the lever 400 is not visible on account of the sectional view. Thus, the lever 400 in the exemplary embodiment from FIG. 1 can be similar or identical in design to the lever 400 in the exemplary embodiment from FIG. 3 and can have the second support disk 420 with a second partially circular outer contour 421, wherein the second support disk 420 is designed to support the lever 400 in a second bearing shell 520. The second support disk 420 is spaced apart from the first support disk 410.

The clamping spring 200 in the exemplary embodiment from FIG. 1 has clamping leg 210 and a support leg 220, and a spring bend 230 connecting the leg 210 and support leg 220. The clamping spring 200 is shown in a sectional view in FIG. 1. The clamping leg 210 forms a clamping point K with the bus bar 100 for clamping the electrical conductor 2 to the bus bar 100. The situation without a clamped electrical conductor 2 is shown in FIG. 1.

Figure 3:
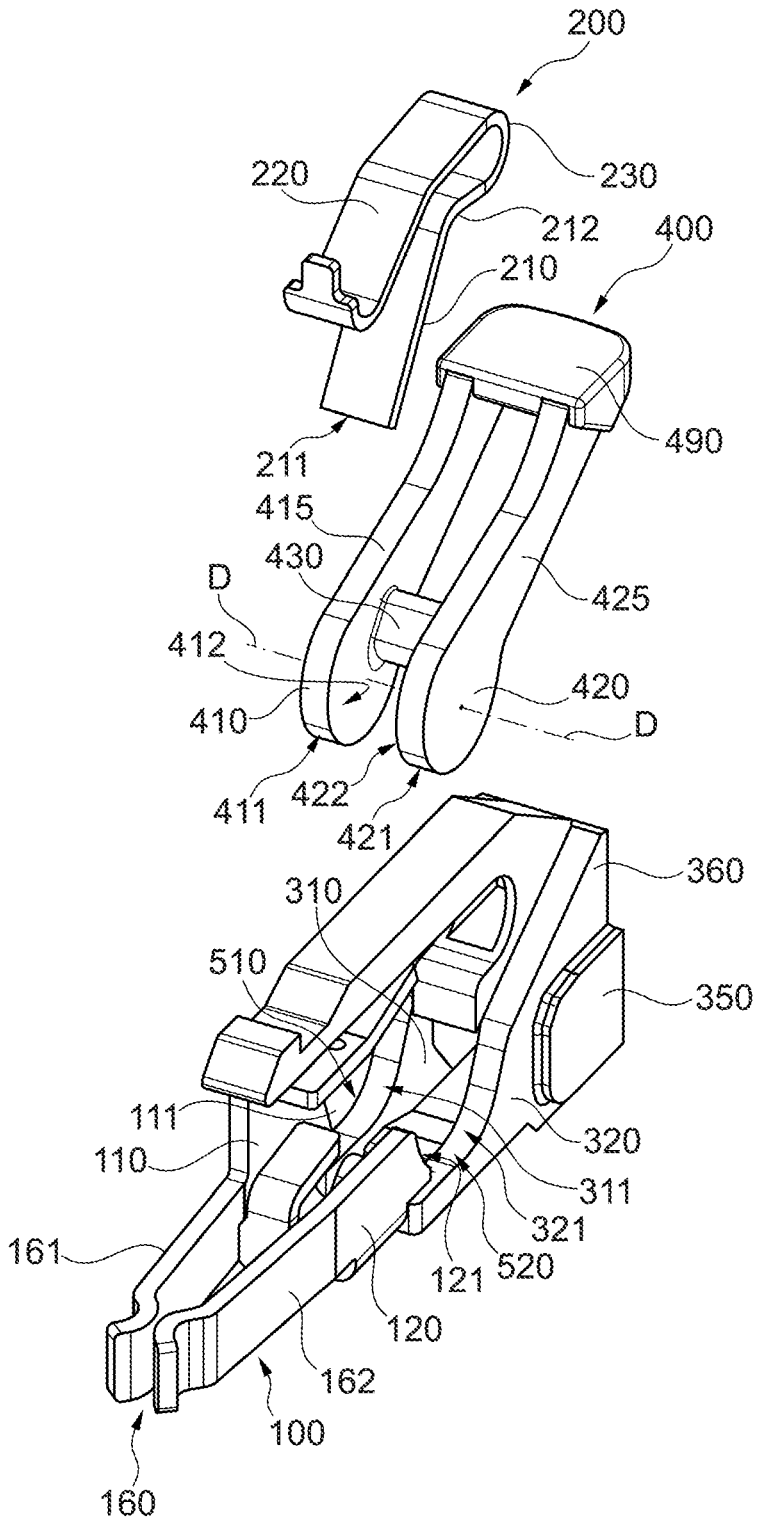
FIG. 3 is a three-dimensional view of elements of an exemplary embodiment.

In the exemplary embodiment from FIG. 1, the lever 400 is shown with an operating handle 490 that, as in FIG. 3, is attached to the first support disk 410 as well as to the second support disk 420. When the operating handle 490 of the lever 400 is manually gripped and moved, the lever 400 performs a pivoting motion, since the operating handle 490 is connected through the web 415 to the first support disk 410. In the exemplary embodiment from FIG. 1, the lever 400 is implemented as a single piece with the operating handle 490, web 415, and first support disk 410, and is manufactured as a one-piece plastic part through injection molding, for example.

Figure 2:
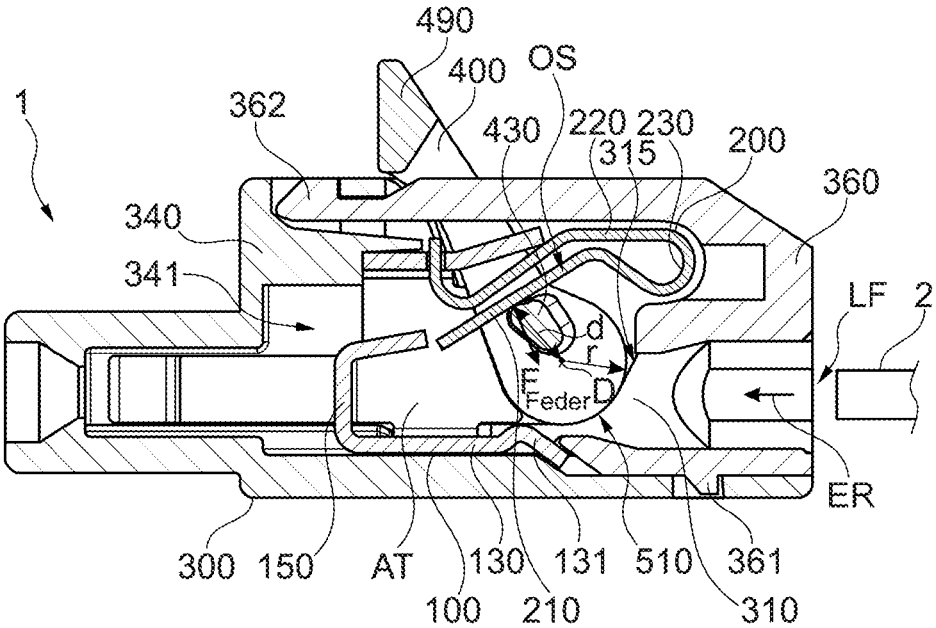
FIG. 2 is another sectional view of an exemplary embodiment.

The lever 400 in the exemplary embodiment from FIG. 1 has a driver 430 that is designed to move the clamping leg 210 from a closed position GS to an open position OS when the lever 400 is pivoted. The closed position GS is shown in FIG. 1 and the open position OS is shown in FIG. 2, in each case in a sectional view with no electrical conductor 2 inserted.

Shown in the exemplary embodiment from FIG. 1 is the first partially circular outer contour 411 of the first support disk 400, which defines a pivot axis D of lever 400 during pivoting of the lever 400. The pivot axis D in the exemplary from FIG. 1 is not a support element, but is rather to be understood as a mathematical axis of rotation. The partially circular outer contour 411 of the first support disk 410 on the partially circular inner contours 111 and 311 of the first bus bar wall section 110 and first housing section 310, respectively. A distinction must be drawn between the support disk 410 and a shaft or the like. Thus, the partially circular outer contour 411 of the support disk 410 has the largest outer radius r in the support area. Preferably, the support disk 410 remains in contact during the greatest part of the pivoting motion with first bus bar wall section 110 as well as with the first housing section 310. In the exemplary embodiment from FIG. 1, the instantaneous center of rotation is stationary, so the pivot axis D does not travel during the pivoting motion.

Since the driver 430 is located at an offset from the pivot axis D within the support disk 410—which is to say within an area defined by the support disk 410—the driver 430 performs a motion along a circular arc during the pivoting motion of the lever 400. The driver 430 has a domed outer surface 435 in the exemplary embodiment from FIG. 1. The domed surface 435 has the result that the distance d between a region of the surface 435 in contact with the clamping leg 210 and the pivot axis D changes during pivoting of the lever 400. The driver 430 in the exemplary embodiment from FIG. 1 has a predominantly kidney-shaped cross-sectional shape. Alternatively (not shown), the driver can also have other shapes, for example predominantly elliptical cross-sectional shapes. FIGS. 1 and 2 show the difference between the closed position GS in FIG. 1 and open position OS in FIG. 2. During a pivoting motion of the lever 400 from the closed position GS, the driver 430 initially comes into contact near the pivot axis D with the clamping leg 210 of the clamping spring 200 and deflects the latter. With the further pivoting motion, the contact area between the clamping leg 210 and the region of the surface 435 of the driver 430 changes in the direction of a greater distance d between the contact region and pivot axis D. In FIG. 2 the open position OS is shown, in which the distance d is maximized. The clamping leg 210 is deflected correspondingly. The lever 400 is located in a position past dead center, so that a spring force vector $F_{Feder}$ at the contact region between the clamping leg 210 and driver surface 435—viewed in the direction of insertion—ER is directed behind the pivot point D, and thus the lever 400 is held in the open position OS by the spring force $F_{Feder}$.

In the exemplary embodiment from FIG. 1, the clamping leg 210 has a clamping edge 211. When the electrical conductor 2 is clamped, the clamping edge 211 deforms the conductor surface of the electrical conductor 2 and maximizes the pull-out force. The clamping leg 210 has a bend 212 between the spring bend 230 and the clamping edge 211. The bend 212 in the exemplary embodiment from FIG. 1 is apart from the clamping edge 211 as well as from the spring bend 230 by straight of the clamping leg 210. The bend produces a more obtuse angle between the insertion direction ER and the section of the clamping leg 210 with the clamping edge 211. The angle between the conductor insertion direction ER and clamping leg 210 is preferably chosen such that a solid electrical conductor 2 can be inserted directly pivoting the lever 400 from the closed position GS into the open position OS.

In the exemplary embodiment from FIG. 1, the driver 430 is arranged such that the driver 430 touches the clamping leg 210 exclusively between the bend 212 and the clamping edge 211 over the lever pivot travel to carry along the clamping leg 210. At the beginning of the pivoting motion, starting from the closed position GS, the driver 430 initially touches the clamping leg 210 in a region adjacent to the bend 212, so that the acting lever arm is initially small. At the same time, the spring force $F_{Feder}$ with small deflection is likewise relatively small. Toward the end of the pivoting motion, i.e., shortly before the open position OS—shown in FIG. 2—the driver 430 touches the clamping leg 210 closer to the clamping edge 211, so that the acting lever arm is larger. Since the spring forces increase with deflection of the spring, this is at least partially compensated for by the elongation of the lever arm, so that an adjusting force at the operating handle 490 experienced by the user over a majority of the pivot travel changes to a minor degree, and in the ideal case remains nearly constant.

Another technical aspect is shown in the exemplary embodiment from FIG. 1. A conductor guide passage LF in the housing 300 is shown that makes it possible to guide the electrical conductor 2 to the clamping point K. When, as shown in FIG. 1, the clamping leg 210 is in the closed position GS, the electrical conductor 2 nonetheless be inserted directly. To this end, the electrical conductor is 2 guided to the clamping point K on all sides to the degree possible. In the exemplary embodiment from FIG. 1, the space up to the clamping point K is bounded by a passage in the housing 300 that is bounded on all sides by walls, and after exiting the passage the space is bounded in the housing 300 by the lever 400 and the clamping spring 200 and the bus 100 and the housing 300. The driver 430 has a bevel 438 that is designed with an to the conductor insertion direction ER in order to guide the electrical conductor 2 to the clamping point K with contact in the direction of the bottom region 230 of the bus bar during direct insertion of the conductor 2. The driver 430 forms part of a funnel-shaped narrowing of the conductor guide passage LF in a gap between housing 300 and clamping leg 210 that is effective during insertion.

In the exemplary embodiment from FIG. 1, the bus bar 100 has the fastening section 140 with an extension 145, wherein the extension 145 is designed as a support for supporting a support leg 220 of the clamping spring 200. For example, in the open position OS in FIG. 2 the force of the deflected spring 200 is absorbed by the support on the extension 145, and forces acting on the housing 300 are distributed more uniformly.

In the exemplary embodiment from FIG. 2, a spring terminal 1 is shown in a sectional view. The spring terminal 1 has a housing 300, a lever 400, a clamping spring 200, and a bus bar 100. The lever 400 of the spring terminal 1 is shown in the open position OS. Accordingly, a clamping leg 210 of the clamping spring 200 is deflected by a driver 430 of the lever 400. A first partially circular outer contour 411 of a first support disk 410 of the lever 400 and a partially circular inner contour 311 of a first housing section 310 of the housing 300 and a partially circular inner contour 111 of a first bus bar wall section (110) of the bus bar 100 have the same radius r. Not shown in FIG. 2—but shown in the exemplary embodiment from FIG. 3, for example—are a second partially circular outer contour 421 of a second support disk 420 of the lever 400 and a partially circular inner contour 321 of a second housing section 320 of the housing 300 and a partially circular inner contour 121 of a second bus bar wall section 120 of the bus bar 100, which preferably likewise have an equal radius r. Preferably, the radii r of the first support disk 410 and the second support disk 420 are likewise equal. Due to equal radii, the support forces are distributed as uniformly as possible on the contours over the pivot travel.

In the exemplary embodiment from FIG. 2, the conductor guide passage LF is closed laterally, except for gaps, by the first inner side 412 of the first support disk 410 and the first housing section 310 and the first bus bar wall section 110. In the open position OS, an unwanted deflection of small strands of a fine-strand conductor is reduced and the strands are guided to the clamping point K in the most bundled manner possible. To this end, the conductor guide passage LF advantageously is closed over a height of the electrical conductor 2 except for gaps between first support disk 410 and housing section 310 and between first support disk 410 and first bus bar wall section and between first bus bar wall section 110 and first housing section 310. As shown in FIG. 2, gaps remain that are unavoidable for design reasons during manufacturing assembly. The exemplary embodiment from FIG. 2 shows especially small gaps by of example, whereas actual implementations of the exemplary embodiment could also dictate significantly larger gaps. What is important in this exemplary embodiment is that these gaps are in turn closed toward the outside by a wall of the housing 300 directly adjacent to the gaps. If the housing is made of an insulating material, adequate insulation is ensured in the region of the gaps.

In the exemplary embodiment from FIG. 2, the bus bar 100 has a tab 150 for forming a conductor-retaining pocket AT for the electrical conductor 2. The tab 150 is formed from a bottom section 130 of the bus bar 100 and is bent over in a U shape. The tab 150 limits an insertion depth of the electrical conductor 2. In the exemplary embodiment from FIG. 2, the tab 150 is also bent over such that the end of the tab 150 and the clamping edge 211 of the clamping spring 200 minimize the gap between the two in the open position OS. In FIGS. 1 and 2 it can also be seen that the clamping leg 210 is positioned closer to the support leg 220 in the open position OS than in the closed position GS.

In the exemplary embodiment from FIG. 2, the spring terminal 1 has an least two-part housing 300. The housing 300 has a receptacle part 340 with an interior 341 for accommodating at least the bus bar 100 and a cover 360 that closes an opening leading into the interior 341. The cover 360 has the first housing section 310 for forming the first bearing shell 510. In addition, the cover 360 has a conductor guide passage LF for introduction of the electrical conductor 2 to the clamping point K. The cover 360 is connected to the receptacle part 340 of the housing 300 through latching elements 362, 362. In addition, the cover 360 has a recess for accommodating the spring bend 230 of the clamping spring 200. To assemble the spring terminal 1, the bus bar 100 is first assembled into a unit with the clamping spring 200 and this unit is introduced into the receptacle part 340. Next, the cover 360 can be inserted into the receptacle part 340 together with the lever 400 until the latches 362, 362 latch.

In FIG. 3 an exemplary embodiment of a spring terminal 1 is shown in an exploded view. Shown is a clamping spring 200 with a support leg 220, a spring bend 230 adjoining the support leg, and adjoining the spring bend 230, a clamping leg 210 with a clamping edge 211 at the free end of the clamping leg 210. The clamping leg 210 also has a bend 212 that defines the angle of incidence of a region of the clamping leg 210 adjacent to the clamping edge 211. The clamping spring 200 of the exemplary embodiment from FIG. 3 is formed as a single piece from a spring steel sheet.

Shown in the exemplary embodiment from FIG. 3 is a lever 400 for actuation of the clamping spring 200. The lever 400 has a first support disk 410 and a second support disk 420. In the exemplary embodiment from FIG. 3, the inner sides 412, 422 of the first and second support disks 410, 420 facing one another are connected to one another through a driver 430. The first support disk 410 is connected to an operating handle 490 of the lever 400 through a first web 415. Similarly, the second support disk 420 is connected to an operating handle 490 of the lever 400 through a second web 425. Advantageously, the operating handle 490, the webs 415, 425, the support disks 410, 420, and the driver 430 are molded from a plastic material as a single piece—manufactured by injection molding, for example. Partially circular outer contours 411, 412 of the first and second support disks 410, 420 define an axis D about which the lever 400 can pivot. The driver 430 advantageously is designed as a continuous strut 430 that extends between the first support disk 410 and the second support disk and that connects the first support disk 410 to the second support disk 420. In the exemplary embodiment from FIG. 3, the driver 430 extends predominantly parallel to the pivot axis D.

In the exemplary embodiment from FIG. 3, the spring terminal 1 has a bearing shell 510 for the first support disk 410 and a second bearing shell 520 for the second support disk 420. The first bearing shell 510 is formed from a first housing 310 of the housing 300 with a partially circular inner contour 311 and from a first bus bar wall section 110 of a bus bar 100, likewise with a partially circular inner contour 111. second bearing shell 520 is formed from a second housing section 320 of the housing with a partially circular inner contour 321 and from a second bus bar wall section 120 of the bus bar 100, likewise with a partially circular inner contour 121. As is shown in 3, the two support disks 410, 420 and associated bearing shells 510, 520 are made parallel. The first housing section 310 and the second housing section 320 part of a housing element that in the exemplary embodiment from FIG. 3 is implemented as the cover 360. The cover 360 has a widening 350 in the region for introduction of a conductor (not shown), in order to be able to accommodate a that is as large as possible together with its plastic insulation. In addition, the cover 360 can be positioned and, if applicable, latched, in the body 340 by means of the widening 350.

The spring terminal 1 of the exemplary embodiment from FIG. 3 also shows that the bus bar 100 has a bifurcated contact 160 with a first leg 161 and a second leg 162. By means of the bifurcated contact 160, a plug-in connection is implemented that is suitable for connecting to a male mating connector with a blade contact. The electrical conductor can thus be electrically connected to an electrical assembly or a plug connector by means of the spring terminal 1.

Figure 4:
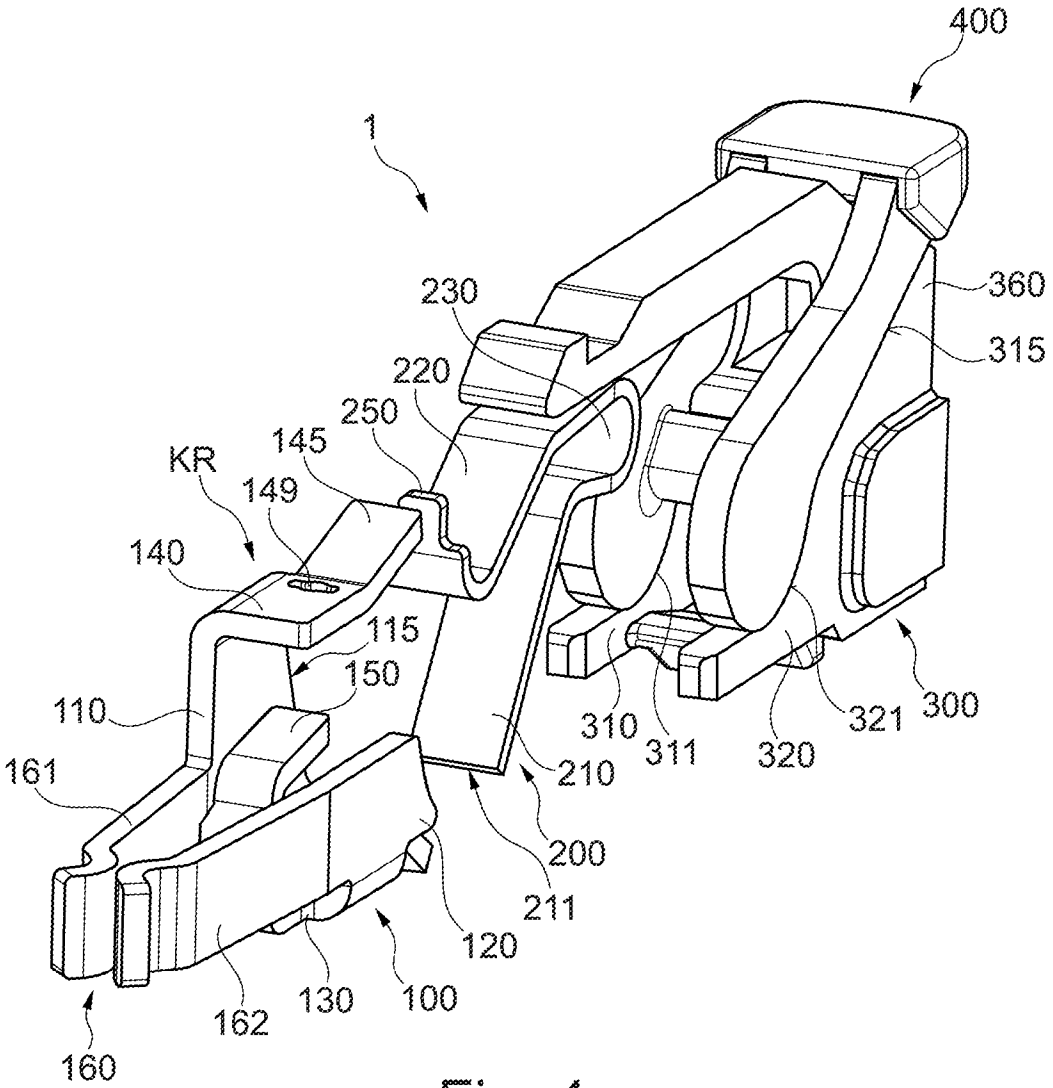
FIG. 4 is another three-dimensional view of elements of an exemplary embodiment.

In the exemplary embodiment from FIG. 4, a spring terminal 1 is shown a partially exploded view. The spring terminal 1 has a bus bar 100 in the form of a non-non-closed contact frame KR. The contact frame KR is formed by a bottom section 130, first bus bar wall section 110, a second bus bar wall section 120, and a fastening 140 of the bus bar 100. The fastening section 140 has a fastener 149 for fastening a support leg 220 of a clamping spring 200. In the exemplary embodiment from FIG. 4, the clamping spring 200 is shown with a clamping leg 210, spring bend 230, and the support leg 220. The support leg 220 has an extension 250 at its free end as a fastener 250, which engages an opening 149 of the fastening section 140 of the bus bar 100. to the support by means of the extension 250 and opening 149, the support leg 220 of clamping spring 200 is secured to the bus bar 100. A clamping edge 211 at the free end the clamping leg 210 is located opposite the support and presses on the bottom section 130 of the bus bar 100 under preloading when the clamping spring 200 is assembled shown in FIG. 4). Accordingly, a support 149, 250 for mounting the support leg 220 the fastening section 140 on one another is formed by the support leg 220 of the spring 200 and the fastening section 140 of the bus bar 100. Alternatively, other 149, 250 can be provided, for example the fastening section 140 can have a pin that engages an opening of the support leg 220 of the clamping spring 200 (not shown in FIG. 4).

In the exemplary embodiment from FIG. 4, the bottom section 130 and the fastening section 140 and the first bus bar wall section 110 and the second bus bar wall section 120 of the bus bar 100 are formed in one piece of a metal part. Copper can be used as the metal for the bus bar 100, for example.

In another exemplary embodiment, the first bus bar wall section 110 and/or the second bus bar wall section 120 have a surface 115 that adjoins the partially circular inner contour and forms a stop 115 for the lever 100 in the open position OS. In the exemplary embodiment from FIG. 4 it is shown that only the first bus bar wall section 110 has a stop 115. In corresponding fashion, the second bus bar wall section 120 could also be elongated for a stop (not shown in FIG. 4), however. The loading by forces of the lever 400 on the housing 300 in the open position OS can be reduced through a stop 115 formed by means of the bus bar 100.

In another exemplary embodiment, the first housing section 310 of the housing 300 and/or the second housing section 320 of the housing 300 has a housing surface 315 that adjoins the partially circular inner contour 311, 321 and forms a stop for the lever 400 in the closed position GS. In the exemplary embodiment from FIG. 4, can be seen that the second housing section 320 has a stop 315. However, the first housing section 310 could also correspondingly have a stop (not hidden in FIG. 4).

For assembly of the spring terminal 1 in the exemplary embodiment from FIG. 4, the clamping spring 200 is first connected to the bus bar 100. An extension 250 of a contact leg 220 of the clamping spring 200 is introduced into an opening 149 on the fastening section 140 of the bus bar 100. The clamping leg 210 of the clamping spring 200 is deflected and positioned behind the raised area 131 of the bottom section 130 of the bus bar 100. By this means, the clamping spring 200 and the bus bar 100 are connected to one another in a positive-locking manner. A contact insert that is suitable for bulk feeding is the result. It is also shown in the exemplary embodiment from FIG. 4 that the lever 400 is positioned in a pre-assembly position on a cover 360 of the housing 300. Once the contact insert composed of the bus bar 100 and clamping spring 200 is introduced into a receptacle part 340 (not shown in FIG. 4) of the housing 300, the receptacle part 340 is closed by the cover 360 (with lever 400), thus completing the spring terminal 1.

Figure 5A:
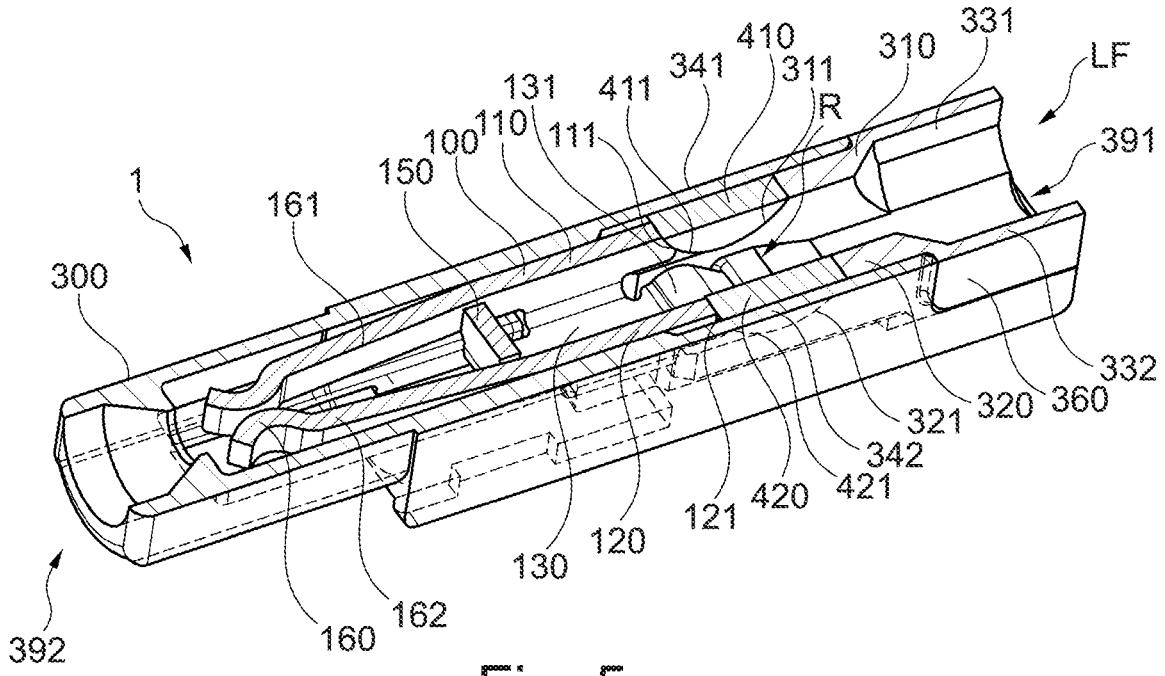
FIGS. 5*a* and 5*b* show additional sectional views of an exemplary embodiment.
Figure 5B:
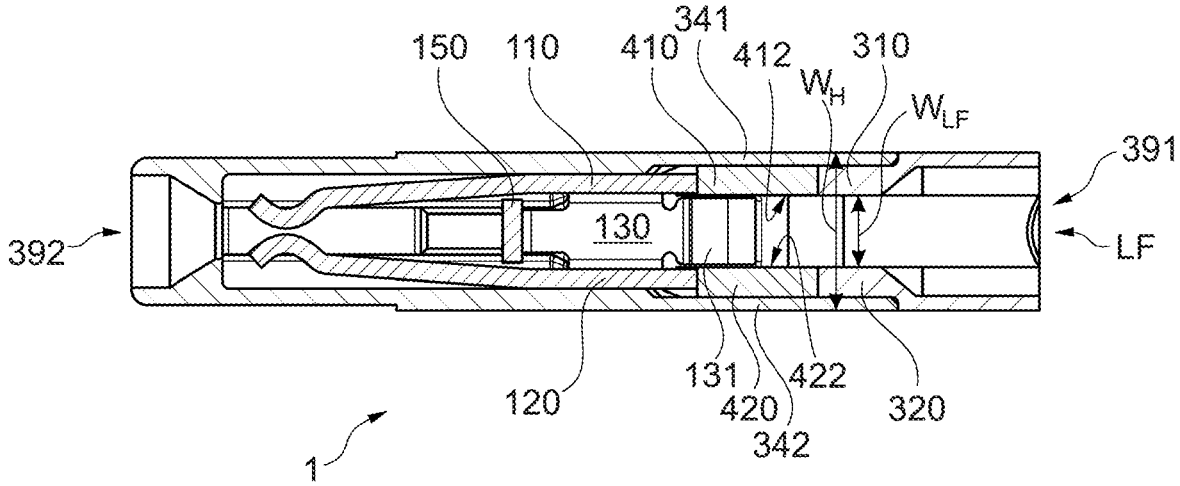

In FIGS. 5*a* and 5*b*, another exemplary embodiment of a spring terminal 1 is shown in a horizontal sectional view. The spring terminal 1 has a housing 300 with a conductor opening 391 for an electrical conductor (not shown in FIG. 5*a*), for example a cable with a copper conductor surrounded by electrical insulation. The housing 300 is shown as partially transparent in FIG. 5*a* so that additional elements of the conductor terminal 1 are visible. Moreover, the housing 300 has a second opening for introduction of a contact blade (not shown in FIG. 5*a*) for an electrical blade and fork contact. A bifurcated contact 160 is formed by two legs 161, 162 of a bus bar 100. The bus bar 100 has a bottom section 130 with a raised area 131 for improved clamping of the electrical conductor (not shown in FIG. 5*a*).

A conductor guide passage LF in the exemplary embodiment from FIG. 5*a* extends from the conductor opening 391 in the housing 300 to a tab 150 of the bus bar 100.

The conductor guide passage LF is bounded on a first side by a first guide wall 331 and a first housing section 310 with a first partially circular inner contour 311 and a first support disk 410 and by a first bus bar wall section 110 with a first partially circular inner contour 111. The first housing section 310 and the first support disk 410 and the first bus bar wall section 110 are shown sectioned in FIG. 5*a*. The first support disk 410 with partially circular outer contour 411 is rotatably supported in the partially circular inner contours 311, 111 of the first housing section 310 and of the first bus bar wall section 110.

The conductor guide passage LF is bounded on a second side by a second guide wall 332 and a second housing section 320 with a second partially circular inner contour 321 and a second support disk 420 and by a second bus bar wall section 120 with a second partially circular inner contour 121. The second housing section 320 and the second support disk 420 and the second bus bar wall section 120 are shown sectioned in FIG. 5*a*. The second support disk 420 with partially circular outer contour 421 is rotatably supported in the partially circular inner contours 321, 121 of the second housing section 320 and of the second bus bar wall section 120.

In the exemplary embodiment from FIGS. 5*a* and 5*b*, an especially large insertable conductor cross-section is achieved through an especially wide conductor guide passage LF with an especially narrow design of the housing 300 at the same time. As is shown in FIG. 5*b*, the guide walls 331, 332 of the conductor guide passage LF advantageously spring outward in the region of the conductor opening 391, so that an insulation of the electrical conductor (not shown) can be also introduced into this region.

In the exemplary embodiment from FIGS. 5*a* and 5*b*, the support disks 410, 420 are laterally supported by the housing walls 341 and 342. In advantageous fashion, the first support disk 410 is laterally guided exclusively by the first outer wall 341 of the housing 300. In advantageous fashion, the second support disk 420 is laterally guided exclusively by the second outer wall 342 of the housing 300. In this exemplary embodiment, an outer wall 341, 342 is likewise to be understood to mean a wall that is associated with two spring terminals and can also be referred to as a separating wall. Bus bars of two adjacent spring terminals 1 are electrically insulated from one another by this separating wall (not shown in FIG. 5*a*).

The lateral guidance by the housing walls 341, 342 limits a motion of the support disks 410, 420 in the axial direction. A width $W_{LF}$ of the conductor guide passage LF is defined in the region of the first support disk 410 and the second support disk 420 by the housing width $W_H$ less the thicknesses of the first housing wall 341 and the second housing wall 342 and less the thicknesses of the first support disk 410 and the second support disk 420. Accordingly, the maximum conductor cross-section, which is delimited by the width $W_{LF}$ of the conductor guide passage LF, governs the width $W_H$ of the housing 300 with required electrical insulation values by means of the aforementioned thicknesses. No other walls are needed for support or housing stabilization, so the spring terminal 1 can be implemented with optimal width.

The housing 300 has the first guide wall 331 and the second guide wall 332 of the conductor guide passage LF, wherein the conductor guide passage LF guides the electrical conductor (not shown) that is to be inserted from outside into the conductor opening 391 to the clamping point. The conductor guide passage LF is formed to accommodate the electrical conductor in the region of the first support disk 410 and the second support disk 420 by a space R between the first support disk 410 and the second support disk 420. In the exemplary embodiment from FIGS. 5*a* and 5*b*, the space R is bounded by the bottom section 130 of the bus bar 100.

Advantageously, the first housing section 310 and a first inner side 412 of the first support disk 410 facing the electrical conductor are aligned in the conductor insertion direction of the electrical conductor. Advantageously, the second housing section 320 and a second inner side 422 of the second support disk 420 facing the electrical conductor are aligned in the conductor insertion direction of the electrical conductor. Advantageously, the first inner side 412 of the first support disk 410 facing the electrical conductor and the first bus bar wall section 110 of the bus bar 100 are aligned in the conductor insertion direction of the electrical conductor. Advantageously, the second inner side 422 of the second support disk 420 facing the electrical conductor and the second bus bar wall section 120 of the bus bar 100 are aligned in the conductor insertion direction of the electrical conductor. By this means, edges transverse to the direction of insertion of the electrical conductor that the electrical conductor could strike are largely avoided. In addition, the danger that thin strands of a fine-strand conductor will be deflected at the edges and not guided to the clamping point is reduced.

In the exemplary embodiment from FIGS. 5*a* and 5*b*, the spring terminal is advantageously designed for fine-strand and multi-strand conductors. The conductor guide passage LF is closed laterally by the first inner side 412 of the first support disk 410 and the first housing section 310 and the first bus bar wall section 110. The closed region advantageously extends over at least a height of the electrical conductor in the spring terminal starting from the bottom section 130 of the bus bar 100. The closed region is closed except for gaps between first support disk 410 and first housing section 310 and between first support disk 410 and first bus bar wall section 110 and between first bus bar wall section 110 and first housing section 310.

The conductor guide passage LF is also closed laterally by the second inner side 422 of the second support disk 420 and the second housing section 320 and the second bus bar wall section 120. The closed region likewise advantageously extends over at least the height of the electrical conductor in the spring terminal starting from the bottom section 130 of the bus bar 100. The closed region is closed except for gaps between second support disk 420 and second housing section 320 and between second support disk 420 and second bus bar wall section 120 and between second bus bar wall section 120 and second housing section 320. The gaps may vary by manufacturing process. With regard to electrical insulation, however, even relatively large gaps are noncritical, since they are advantageously fully closed toward the outside by directly adjacent housing walls 341, 342.

Another aspect of an exemplary embodiment shown in FIGS. 5*a* and 5*b* is a spring terminal 1 that has a housing 300 with a cover 360. The cover has the first housing section 310 for forming the first bearing shell 510 and the second housing section 320 for forming the second bearing shell 520. A first partially circular inner contour 311 of the first housing section 310 extends starting from an opening 391 in the cover 360, viewed in the conductor insertion direction, to behind the pivot axis of the first support disk 410 and the second support disk 420. A second partially circular inner contour 321 of the second housing section 320 extends starting from an opening 391 in the cover 360, viewed in the conductor insertion direction, to behind the pivot axis of the first support disk 410 and the second support disk 420.

Advantageously, the first support disk 410 and the first housing section 310 and the first bus bar wall section 110 of the spring terminal 1 are designed such that the first support disk 410 rests on the partially circular inner contour 311 of the first housing section 310 and on the partially circular inner contour 111 of the first bus bar wall section 110 in the open position OS and in the closed position GS. Advantageously, the second support disk 420 and the second housing section 320 and the second bus bar wall section 120 of the spring terminal 1 are designed such that the second support disk 420 rests on the partially circular inner contour 321 of the second housing section 320 and on the partially circular inner contour 121 of the second bus bar wall section 120 in the open position OS and in the closed position GS. Accordingly, the support disks 410, 420 do not lose contact with relevant bearing cavity 510, 520 over the pivot path, and the probability that a strand of a fine-strand electrical conductor will catch between the contours 111, 121, 311, 321, 411, 421 is significantly reduced.

Another exemplary embodiment of a spring terminal 1 is schematically shown in a sectional view in FIG. 6. The spring terminal 1 has a bus bar 100, a clamping spring 200, a housing 300, and a lever 400, and is designed for connection of an electrical conductor. The bus bar 100 is bent into a frame encompassing at least one side with a bottom section 130 and a bus bar wall section 110 and a fastening section 140 on the top. Located at the top is a window 149 in which the clamping spring 200 is hung. In addition, the bus bar 100 has a support 145 at the top that supports the support leg 220 of the clamping spring 200. The clamping spring 200 and bus bar 100 form a self-supporting system.

Figure 6A:
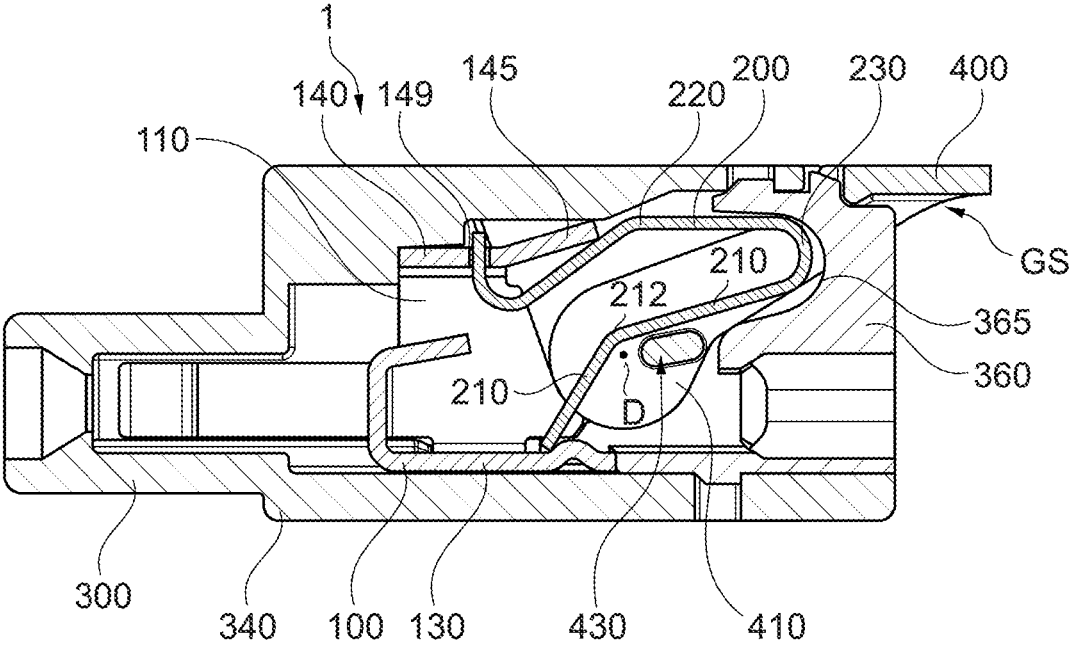
FIG. 6*a* is another sectional view of an exemplary embodiment.

The housing 300 has a body 340 and a cover 360, which in the assembled state is fastened to the body 340. The cover 360 forms a support 365 for the spring base 230 and prevents the clamping spring 200 from coming loose from the bus bar 100 upon direct insertion of a conductor. The support 365 of the housing 300 for the spring base 230 in the exemplary embodiment from FIG. 6*a* is implemented as an approximately circular recess. The spring base 230 in the exemplary embodiment from FIG. 6*a* is fully contained in the approximately partially circular recess 365. The outer surface of the spring base 230 is supported on the inner surface of the approximately partially circular recess 365.

Figure 6B:
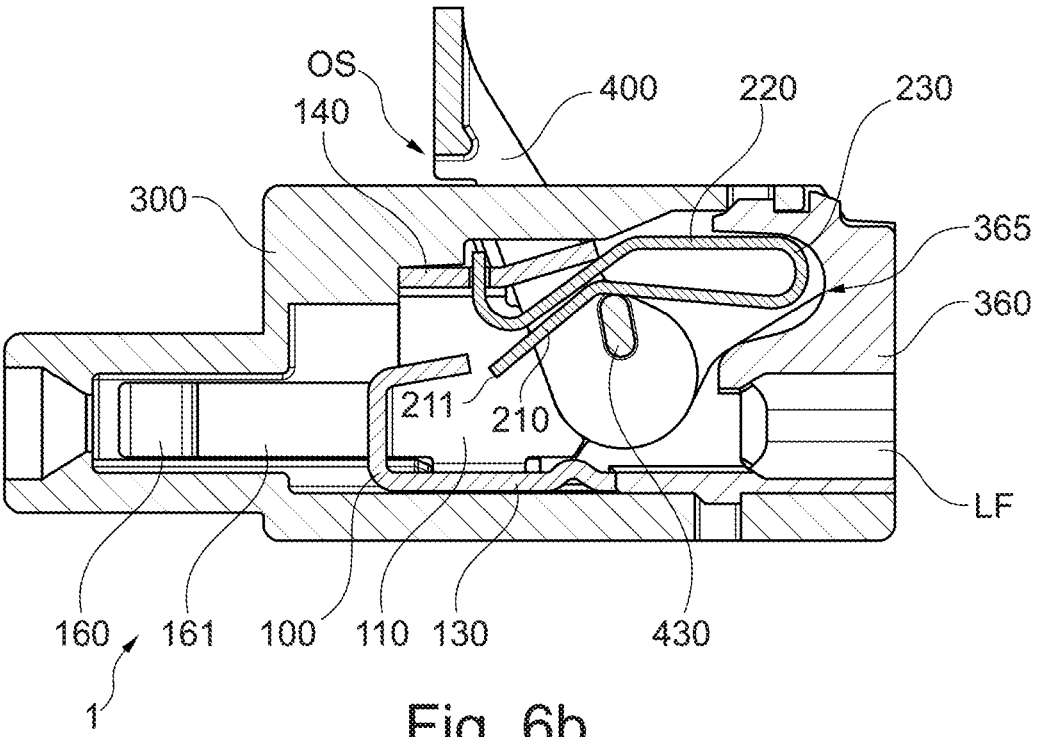
FIG. 6*b* is another sectional view of an exemplary embodiment.

The lever 400 has a fixed pivot point D. A partially circular outer contour of a first support disk 410 forms a bearing surface that rubs on a partially circular inner contour of a bus bar wall section 110 of the bus bar 100 and a partially circular inner contour of a housing section 310 of the housing 300. Provided as driver 430 is a continuous web 430 between the lever sides 410, 420 that permits opening of the clamping spring 200. In the exemplary embodiment from FIGS. 6*a* and 6*b*, the driver 430 is arranged such that the driver 430 is arranged such that the driver 430 touches the clamping leg 210 exclusively between a bend 212 and the clamping edge 211 over the lever pivot travel to carry along the clamping leg 210. In a sectional view, FIG. 6*a* shows the closed position GS, and FIG. 6*b* shows the open position OS. The lever 400 and clamping spring 200 are designed such that the open position OS is maintained without additional latching. In other words, the lever remains in the open position OS by self-locking, without the need for a latching element.

The driver 430 in the exemplary embodiment from FIGS. 6*a* and 6*b* is arranged within an area of the first support disk 410 and an area of a second support disk (not shown in the sectional view) such that in the region of the closed position GS a spring force acts on the driver 430 predominantly in the tangential direction with respect to the partial circle of each support disk 410, 420, and in the region of the open position acts on the driver 430 predominantly in the radial direction with respect to the partial circle of each support disk 410, 420. In the region of the open position OS, the clamping leg 210 and the support leg 220 of the clamping spring 200 are close to one another or touch one another. In contrast, in the closed position GS the clamping leg 210 and support leg 220 are maximally separated from one another.

In the open position OS in FIG. 6*b*, a conductor (not shown) can be connected in the conductor terminal 1. To this end, the conductor is introduced through the conductor guide passage LF. The bus bar 100, lever 400, and cover 360 of the housing 300 form a conductor guide. Likewise, conductor connection of a rigid conductor is possible (push-in) in the closed position GS from FIG. 6*a*. The clamping leg 210 of the clamping spring 200 is deflected by the rigid conductor during insertion. A clamping edge 211 of the clamping leg 210 penetrates into the material of the rigid conductor and prevents pull-out of the conductor from the conductor terminal 1 up to a desired pull-out force. To release the rigid conductor, the lever 400 is simply brought into the open position OS. The exemplary embodiment from FIGS. 6*a* and 6*b* shows a conductor terminal 1 in a very compact arrangement that permits a small installation space, in particular a small installation width and small installation height.

Figure 7:
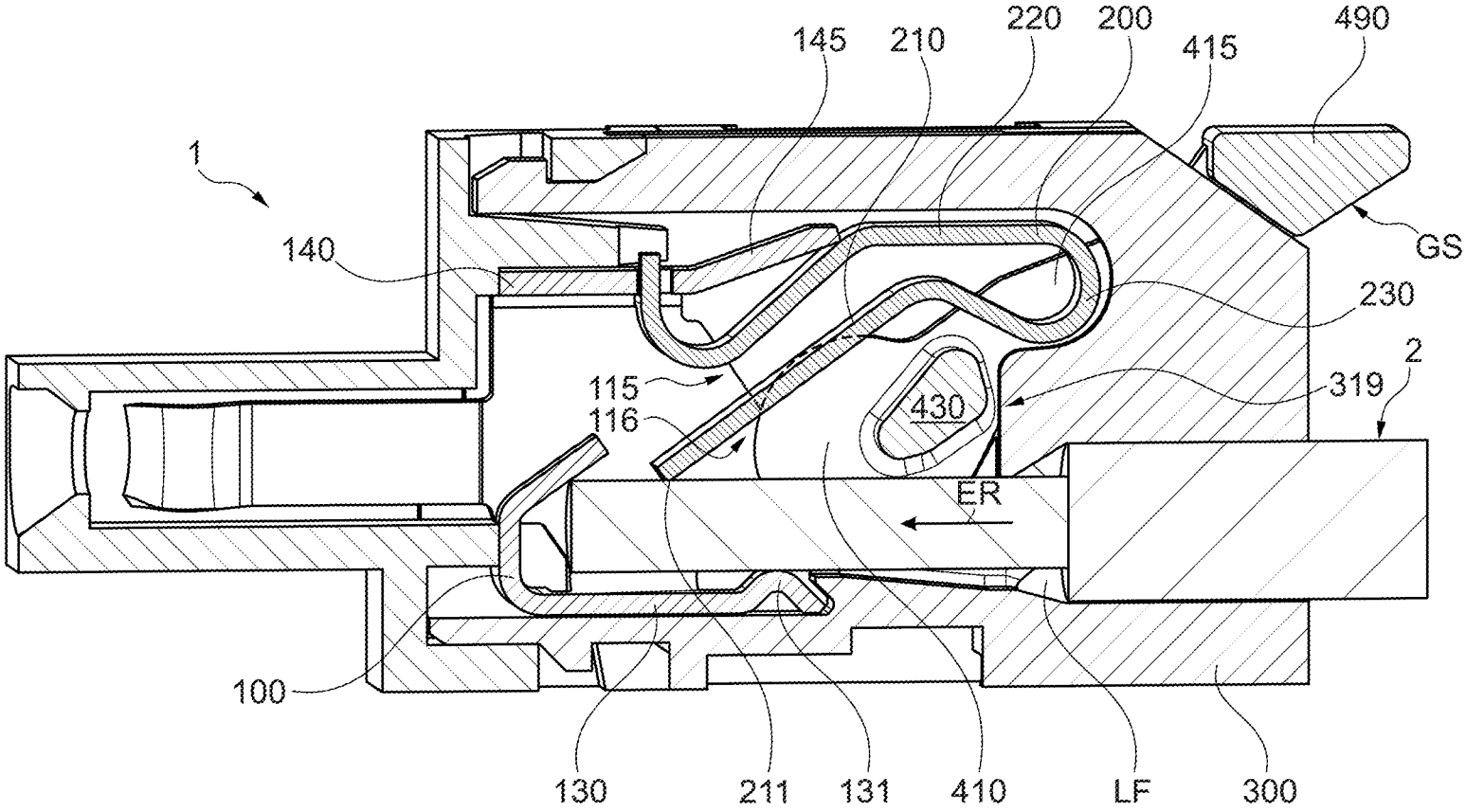
FIG. 7 is another sectional view of an exemplary embodiment.

An exemplary embodiment of a spring terminal 1 is shown in FIG. 7 in a sectional view. Shown is that an electrical conductor 2 is connected in the spring terminal 1. The spring terminal 1 has a bus bar 100 and a clamping spring 200 and a housing 300 and a lever 400. The lever 400 is designed to deflect a clamping leg 210 of the clamping spring 200, for example in order to remove the clamped conductor 2 from the spring terminal 1 again. In FIG. 7, the lever 400 is shown in the closed position GS. Accordingly, an operating handle 490 of the lever 400 is shown in an initial position. The lever 400 is pivotably supported within the housing 300.

The lever 400 has a first support disk 410 with a first partially circular outer contour 411 for supporting the lever 400 in a first bearing shell. The operating handle 490 of the lever 400 is connected to the first support disk 410 through a first web 415. The lever 400 has a driver 430 that is designed to move the clamping leg 210 from the closed position GS into an open position (not shown in FIG. 7) when the lever 400 is pivoted.

If a conductor 2 is inserted, as is shown in FIG. 7, a clamping edge 211 of the clamping leg 210 presses against the conductor 2. In this case, the clamping edge 211 penetrates into the material of the conductor 2 and thus significantly increases the pull-out forces. The conductor 2 in turn presses against the raised area 131. Accordingly, the clamping leg 210 of the clamping spring 200 together with the bus bar 100 forms a clamping point for clamping the electrical conductor 2 to the bus bar 100. If the lever 400 is also in the closed position GS, as shown in FIG. 7, the clamping leg 210 does not rest against the driver 430 of the lever 400.

The bearing shell has a contour that prevents the lever 400 in the housing 300 from moving freely when the conductor 2 is inserted and the lever 400 is in the closed position. To this end, the bearing shell has a lug 116 or projection 116 that partially surrounds the first support disk 410 so that the support disk 410 is not movable or has limited mobility perpendicular to the insertion direction ER. At the same time, the driver 430 of the lever 400 strikes a housing wall 319 in the closed position GS, so that the lever 400 also is not movable or has limited mobility opposite to the insertion direction ER. The features of the exemplary embodiment from FIG. 7 can be combined with the features of the exemplary embodiment from FIG. 3, so that the lever 400 from FIG. 7, for example, is supported in two bearing shells by means of two support disks, wherein each bearing shell is formed from a combination of a bus bar wall section and housing section.

Figure 8:
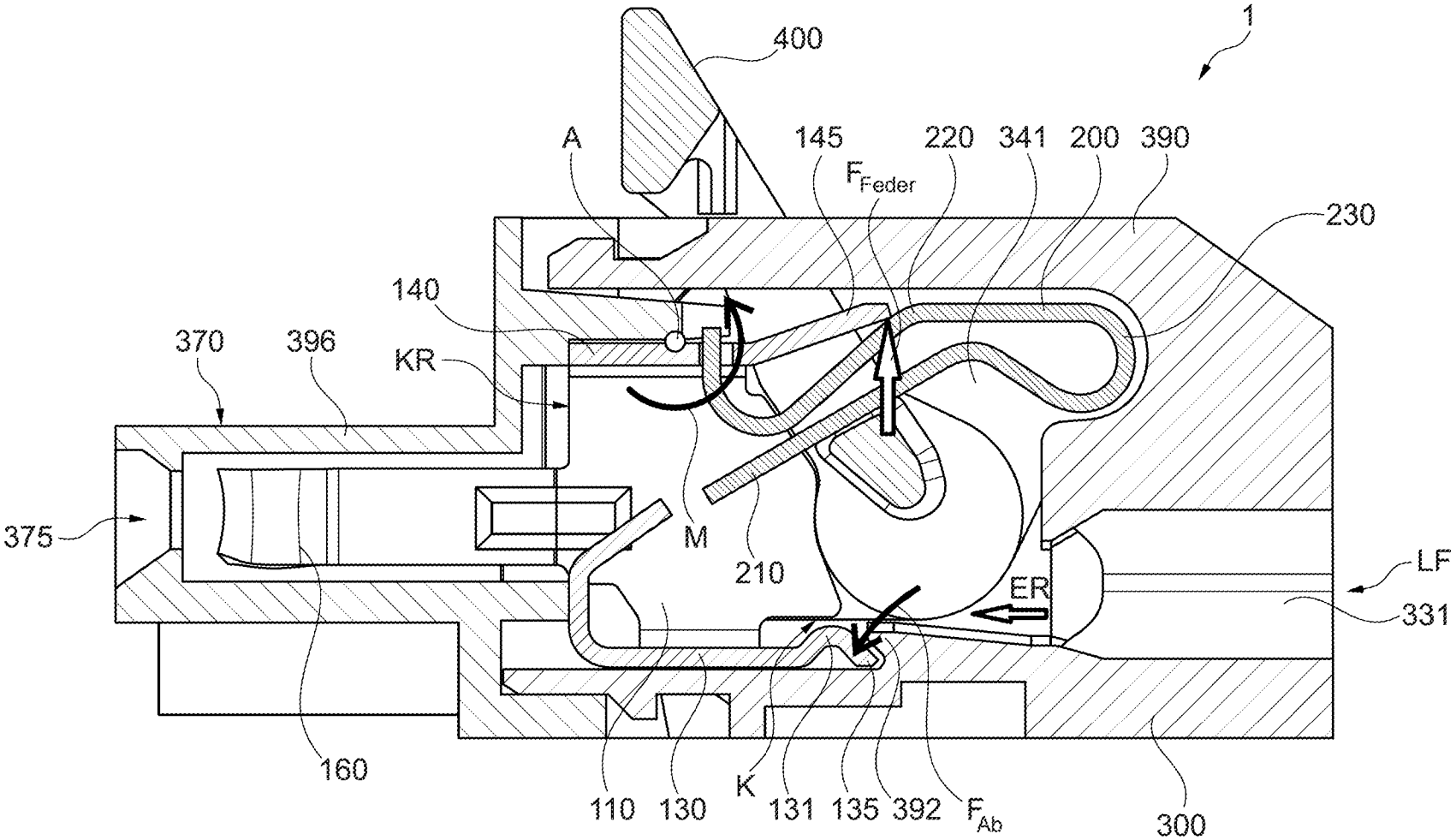
FIG. 8 is another sectional view of an exemplary embodiment.

An exemplary embodiment of a spring terminal 1 is shown in a sectional view in FIG. 8. The spring terminal has a bus bar 100 and a clamping spring 200 and a housing 300 and an operating element 400. In the exemplary embodiment from FIG. 8, the operating element 400 is designed as a lever 400. Alternatively, the operating element 400 can be designed as a pusher or slide or the like.

The clamping spring 200 has a clamping leg 210 for clamping an electrical conductor (not shown in FIG. 8). In addition, the clamping spring 200 has a support leg 220 and a spring bend 230. The spring bend 230 connects the support leg 220 to the clamping leg 210. In the exemplary embodiment from FIG. 8, the clamping spring 200 is formed as a single piece from a spring steel. The support leg 220 is supported on an extension/support 145 of the bus bar 100. When the clamping leg 210 of the clamping spring 200 is deflected, as shown in FIG. 8, the support leg exerts a spring force $F_{Feder}$ that acts on the bus bar 100 through the support of the support leg 220 on the extension/support 145.

The bus bar 100 has a bottom section 130 for clamping the electrical conductor to the bottom section 130 of the bus bar 100 by means of the clamping leg 210 of the clamping spring 200. The bus bar 100 also has a fastening section 140 for fastening the support leg 220 of the clamping spring 200. In the exemplary embodiment from FIG. 8, the tab 145 is a part of the fastening section. The bus bar 100 is formed as a single piece of a metal (e.g., copper, copper alloy), for example. The bus bar 100 forms a contact frame KR by the means that at least one bus bar wall section 110, 120 of the bus bar 100 connects the bottom section 130 to the fastening section 140 as a single piece.

In the exemplary embodiment from FIG. 8, the bus bar 100 is supported in the housing 300. On account of, e.g., necessary or unavoidable manufacturing tolerances, the contact frame KR has a small play within the housing 300. When the clamping leg 210 is deflected, as shown in FIG. 8, the spring force $F_{Feder}$ acts on the contact frame at the outermost point (at the top right in FIG. 8). The spring force $F_{Feder}$ in this case is directed transversely, at approximately 90°, to the insertion direction ER of the conductor. This spring force $F_{Feder}$ causes a torque M of the bus bar 100 relative to the housing 300. The torque M here acts about the reference point A, which in this case can also be referred to as the pivot point.

The housing 300 has a stop 392 to significantly restrict a rotary motion of the bus bar 100 relative to the housing 300 when the clamping leg 210 is deflected. The stop 392 here is formed at a location within the housing 300 that is as far as possible from the reference point A. In the exemplary embodiment from FIG. 8, the reference point A is located in the region of the fastening section 140 of the bus bar 100. A free end 135 of the bottom section 130 rests on the stop 392 to support the torque M. As a result of the support, a support force $F_{Ab}$ acts on the free end 135 of the bottom section 130 in opposition to a rotary motion. For example, the stop 392 is implemented as an undercut 392 in the plastic of the housing 300. In the exemplary embodiment from FIG. 8, the free end 135 enters a recess of the undercut 392.

In the exemplary embodiment from FIG. 8, the free end 135 of the bottom section 130 is formed at a side of the bus bar 100 that faces the lever 400. In this way, a chain of forces through the lever 400 and through the housing 300 is closed through the shortest possible path. A raised area 131 of the bus bar 100 borders the free end 135 of the bus bar 100. The raised area 131 here, together with the clamping leg 210, forms a clamping point K for the electrical conductor. The electrical conductor is guided in the insertion direction ER through a conductor guide passage LF in the body 390 of the housing 300 to the clamping point K with the guidance of a number of guide walls 331 and the lever 400.

Figure 9:
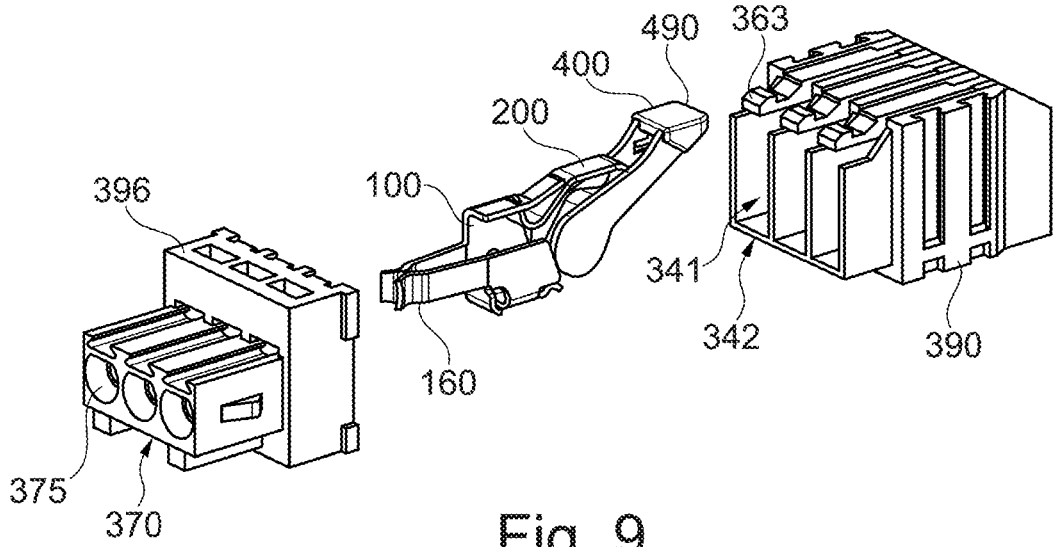
FIG. 9 is a three-dimensional view of an exemplary embodiment.
Figure 10:
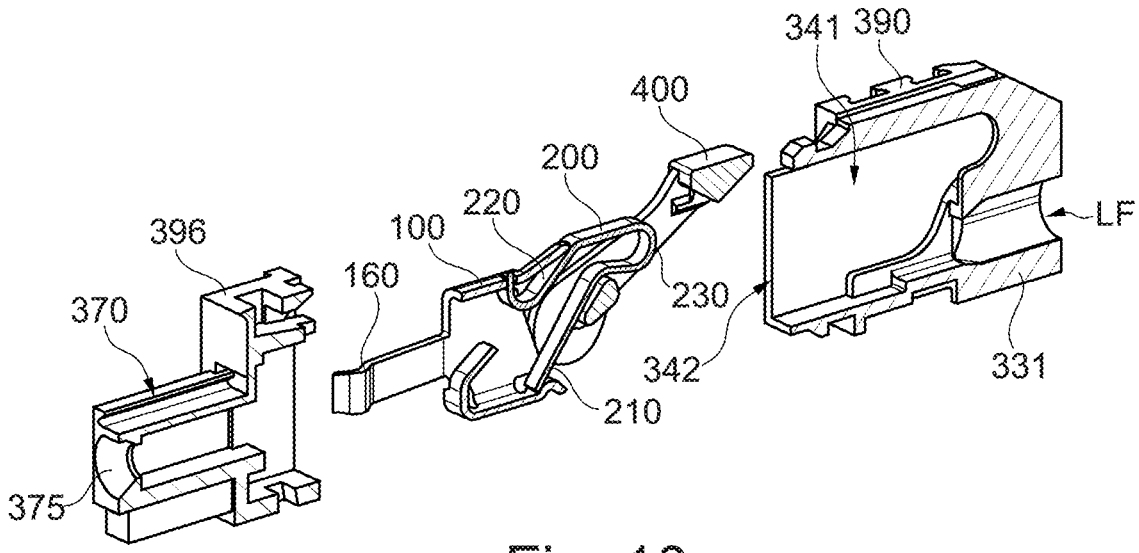
FIG. 10 is a sectioned three-dimensional view of an exemplary embodiment.

An exemplary embodiment of a spring terminal 1 is shown in FIG. 9 in a three-dimensional view. An exemplary embodiment of a spring terminal 1 is shown in FIG. 10 as a sectioned three-dimensional view.

The spring terminal 1 has a bus bar 100 and a clamping spring 200 and a lever 400 as the operating element 400. The housing has a body 390 and a cover 396. The body 390 has an interior 341 for accommodating the bus bar 100 and the clamping spring 200 and the operating element 400, wherein in the exemplary embodiment from FIG. 9 an operating handle 490 for manual operation projects from the body 390. Located in the body 390 are a number of guide walls 331 for forming a conductor guide passage LF to guide the electrical conductor (not shown in FIGS. 9 and 10). In the sectional view in FIG. 10, one guide wall 331 of the guide walls is shown in the body 390.

The body 390 has a housing opening 342 for introduction of the lever 400 and the clamping spring 200 and the bus bar 100 into the body 390. The cover 396 closes the housing opening 342 of the body 390 so that the bus bar 100 and the clamping spring 200 are encapsulated by the body 390 and cover 396 in a touch-proof manner. The cover 396 has a plug-in face 370 with a contact opening 375 for electrically contacting the bus bar 100. The plug-in face 370 is part of a plug connection and is designed to fit a mating plug. An especially compact spring contact 1 can be achieved through the exemplary embodiment from FIG. 10.

The body 390 is designed such that the operating element 400 can be introduced through the housing opening 342 before or together with the clamping spring 200 and the bus bar 100. For example, the clamping spring 200 is preassembled to the bus bar 100 so that a unit composed of the bus bar 100 and clamping spring 200 can be fed in a manner that is automated and compatible with bulk feeding. This makes it possible by automation for the lever 400 to be introduced into the body 390 first, and then the bus bar 100 and clamping spring 200 to be introduced into the body 390 before the housing opening 342 of the body 390 is closed by the cover 396.

In the exemplary embodiment from FIG. 9, it is shown that the bodies 390 of multiple spring terminals 1 are formed in a single piece as one element. In addition, covers 396 of multiple spring terminals 1 are formed in a single piece as one element. Due to the latching elements 363 of each spring terminal 1, relatively large forces can be accommodated in the housing. For example, if an inserted conductor is pulled opposite to the insertion direction (pull-out force), multiple latching elements 363 hold the body 390 and cover 396 together. Advantageously, the cover 396 can be made of a polyamide (PA) as a result.

In the exemplary embodiment from FIG. 9 or FIG. 10, the bus bar 100 inside the cover 396 has a bifurcated contact 160. Alternatively, the bus bar 100 can have a blade contact in the cover 396. Preferably, the bus bar 100 is formed of a metal as a single piece with the bifurcated contact 160 or the blade contact.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A spring terminal for connection of an electrical conductor, the spring terminal comprising:

a bus bar, comprising a first bus bar wall section;

a clamping spring;

a housing; and a lever, wherein the bus bar and the clamping spring and the lever are accommodated at least partially in the housing, wherein the lever has a first support disk with a first partially circular outer contour for supporting the lever in a first bearing shell, wherein the lever has a second support disk with a second partially circular outer contour for supporting the lever in a second bearing shell, wherein the second support disk is spaced apart from the first support disk, wherein the lever has an operating handle that is connected to the first support disk and to the second support disk, wherein the clamping spring has a clamping leg, wherein the clamping leg forms a clamping point with the bus bar for clamping the electrical conductor to the bus bar, wherein the lever has a driver that is adapted to move the clamping leg from a closed position to an open position when the lever is pivoted, and wherein the first bearing shell is at least formed from a partially circular inner contour of the first bus bar wall section of the bus bar.

2. The spring terminal according to claim 1, wherein the clamping spring has the clamping leg and a support leg, and has a spring bend connecting the clamping leg and support leg.

3. The spring terminal according to claim 2, wherein the support leg of the clamping spring and the fastening section of the bus bar have a bearing for mounting the support leg and the fastening section on one another.

4. The spring terminal according to claim 1, wherein the bus bar further comprises a second bus bar wall section, and wherein the second bearing shell is at least formed from a partially circular inner contour of the second bus bar wall section of the bus bar.

5. A spring terminal for connection of an electrical conductor, the spring terminal comprising:

a bus bar, comprising a first bus bar wall section;

a clamping spring;

a housing; and a lever, wherein the bus bar and the clamping spring and the lever are accommodated at least partially in the housing, wherein the lever has a first support disk with a first partially circular outer contour for supporting the lever in a first bearing shell, wherein the lever has a second support disk with a second partially circular outer contour for supporting the lever in a second bearing shell, wherein the second support disk is spaced apart from the first support disk, wherein the lever has an operating handle that is connected to the first support disk and to the second support disk, wherein the clamping spring has a clamping leg, wherein the clamping leg forms a clamping point with the bus bar for clamping the electrical conductor to the bus bar, wherein the lever has a driver that is adapted to move the clamping leg from a closed position to an open position when the lever is pivoted, wherein the first bus bar wall section of the bus bar has a partially circular inner contour, and wherein the first bearing shell is formed from a first housing section of the housing with a partially circular inner contour, and from the first bus bar wall section of the bus bar.

6. The spring terminal according to claim 5, wherein a radius of the first partially circular outer contour of the first support disk is no larger than a radius of the partially circular inner contour of the first housing section and/or of the first bus bar wall section, and/or wherein a radius of the second partially circular outer contour of the second support disk is no larger than a radius of the partially circular inner contour of the second housing section and/or of the second bus bar wall section.

7. The spring terminal according to claim 5, wherein the housing includes a receptacle part with an interior for accommodating at least the bus bar and a cover, wherein the cover closes an opening of the receptacle part leading into the interior, wherein the cover has the first housing section for forming the first bearing shell and/or the cover has the second housing section for forming the second bearing shell, and/or wherein the receptacle part has the first housing section for forming the first bearing shell and/or the receptacle part has the second housing section for forming the second bearing shell.

8. The spring terminal according to claim 7, wherein the housing or the cover has a first guide wall and/or a second guide wall of a conductor guide passage, and wherein the conductor guide passage guides the electrical conductor to a clamping point.

9. The spring terminal according to claim 8, wherein the conductor guide passage is closed laterally by the first inner side of the first support disk and the first housing section and the first bus bar wall section over a height of the electrical conductor, except for gaps between first support disk and first housing section and between first support disk and first bus bar wall section and between first bus bar wall section and first housing section, and/or wherein the conductor guide passage is closed laterally by the second inner side of the second support disk and the second housing section and the second bus bar wall section over a height of the electrical conductor, except for gaps between second support disk and second housing section and between second support disk and second bus bar wall section and between second bus bar wall section and second housing section.

10. The spring terminal according to claim 5, wherein the first housing section and a first inner side of the first support disk facing the electrical conductor are aligned at least in the conductor insertion direction, and/or wherein the second housing section and a second inner side of the second support disk facing the electrical conductor are aligned at least in the conductor insertion direction.

11. The spring terminal according to claim 5, wherein the bus bar forms a contact frame together with a bottom section and a fastening section and the first bus bar wall section and/or the second bus bar wall section.

12. The spring terminal according to claim 11, wherein the bottom section and the fastening section and the first bus bar wall section and the second bus bar wall section of the bus bar are formed in one piece of a metal part.

13. The spring terminal according to claim 11, wherein the fastening section of the bus bar has an extension as a support for supporting a support leg of the clamping spring.

14. The spring terminal according to claim 5, wherein the first bus bar wall section and/or the second bus bar wall section has a surface that adjoins the inner contour and forms a stop for the lever in the open position.

15. The spring terminal according to claim 5, wherein the first housing section of the housing and/or the second housing section of the housing has a housing surface that adjoins the partially circular inner contour and forms a stop for the lever in the closed position.

16. A spring terminal for connection of an electrical conductor, the spring terminal comprising:

a bus bar;

a clamping spring;

a housing; and a lever, wherein the bus bar and the clamping spring and the lever are accommodated at least partially in the housing, wherein the lever has a first support disk with a first partially circular outer contour for supporting the lever in a first bearing shell, wherein the lever has a second support disk with a second partially circular outer contour for supporting the lever in a second bearing shell, wherein the second support disk is spaced apart from the first support disk, wherein the lever has an operating handle that is connected to the first support disk and to the second support disk, wherein the clamping spring has a clamping leg, wherein the clamping leg forms a clamping point with the bus bar for clamping the electrical conductor to the bus bar, wherein the lever has a driver that is adapted to move the clamping leg from a closed position to an open position when the lever is pivoted, wherein the housing has a cover with a first housing section for forming the first bearing shell and with a second housing section for forming the second bearing shell, wherein a first partially circular inner contour of the first housing section extends, viewed in a conductor insertion direction, to behind a pivot axis of the first support disk, and wherein a second partially circular inner contour of the second housing section extends, viewed in the conductor insertion direction, to behind a pivot axis of the second support disk.

17. The spring terminal according to claim 16, wherein the first support disk in the open position rests on the partially circular inner contour of the first housing section and on the inner contour of the first bus bar wall section, and/or wherein the first support disk in the closed position rests on the partially circular inner contour of the first housing section and on the inner contour of the first bus bar wall section.

18. The spring terminal according to claim 16, wherein the second support disk in the open position rests on the partially circular inner contour of the second housing section and on the inner contour of the second bus bar wall section, and/or wherein the second support disk in the closed position rests on the partially circular inner contour of the second housing section and on the inner contour of the second bus bar wall section.

19. A spring terminal for connection of an electrical conductor, the spring terminal comprising:

a bus bar, comprising:

a first bus bar wall section; and
a second bus bar wall section;
a clamping spring;
a housing; and
a lever,
wherein the bus bar and the clamping spring and the lever are accommodated at least partially in the housing,
wherein the lever has a first support disk with a first partially circular outer contour for supporting the lever in a first bearing shell,
wherein the lever has a second support disk with a second partially circular outer contour for supporting the lever in a second bearing shell,
wherein the second support disk is spaced apart from the first support disk,
wherein the lever has an operating handle that is connected to the first support disk and to the second support disk,
wherein the clamping spring has a clamping leg,
wherein the clamping leg forms a clamping point with the bus bar for clamping the electrical conductor to the bus bar,
wherein the lever has a driver that is adapted to move the clamping leg from a closed position to an open position when the lever is pivoted,
wherein the first bus bar wall section of the bus bar has a partially circular inner contour and/or the second bus bar wall section of the bus bar has a partially circular inner contour, and
wherein the bus bar has a tab for forming a conductor-retaining pocket for the electrical conductor, wherein the tab limits an insertion depth of the electrical conductor.

20. A spring terminal for connection of an electrical conductor, the spring terminal comprising:
a bus bar, comprising:
a first bus bar wall section; and
a second bus bar wall section;
a clamping spring;
a housing; and
a lever,
wherein the bus bar and the clamping spring and the lever are accommodated at least partially in the housing,
wherein the lever has a first support disk with a first partially circular outer contour for supporting the lever in a first bearing shell,
wherein the lever has a second support disk with a second partially circular outer contour for supporting the lever in a second bearing shell,
wherein the second support disk is spaced apart from the first support disk,
wherein the lever has an operating handle that is connected to the first support disk and to the second support disk,
wherein the clamping spring has a clamping leg,
wherein the clamping leg forms a clamping point with the bus bar for clamping the electrical conductor to the bus bar,
wherein the lever has a driver that is adapted to move the clamping leg from a closed position to an open position when the lever is pivoted,
wherein the first bus bar wall section of the bus bar has a partially circular inner contour and/or the second bus bar wall section of the bus bar has a partially circular inner contour,
wherein the first partially circular outer contour of the first support disk and the second partially circular outer contour of the second support disk define a pivot axis of the lever during pivoting of the lever from the closed position into the open position, and
wherein the driver has a domed outer surface so that a distance between a region of the surface that is in contact with the clamping leg and the pivot axis changes during pivoting of the lever.

21. A spring terminal for connection of an electrical conductor, the spring terminal comprising:
a bus bar;
a clamping spring;
a housing; and
a lever,
wherein the bus bar and the clamping spring and the lever are accommodated at least partially in the housing,
wherein the lever has a first support disk with a first partially circular outer contour for supporting the lever in a first bearing shell,
wherein the lever has a second support disk with a second partially circular outer contour for supporting the lever in a second bearing shell,
wherein the second support disk is spaced apart from the first support disk,
wherein the lever has an operating handle that is connected to the first support disk and to the second support disk,
wherein the clamping spring has a clamping leg,
wherein the clamping leg forms a clamping point with the bus bar for clamping the electrical conductor to the bus bar,
wherein the lever has a driver that is adapted to move the clamping leg from a closed position to an open position when the lever is pivoted, and
wherein the driver has a predominantly oval or predominantly kidney-shaped or predominantly elliptical cross-sectional shape.

* * * * *